US006513724B1

(12) United States Patent
Joseph et al.

(10) Patent No.: US 6,513,724 B1
(45) Date of Patent: Feb. 4, 2003

(54) METHOD AND APPARATUS FOR DEFINING A SPRAY PATTERN FROM A FUEL INJECTOR

(75) Inventors: J. Michael Joseph, Newport News, VA (US); Dennis Rooker, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 35 days.

(21) Appl. No.: 09/879,141

(22) Filed: Jun. 13, 2001

(51) Int. Cl.[7] ..... F02D 7/00; F02D 1/06

(52) U.S. Cl. ..... 239/5; 239/461; 239/533.12; 239/533.14; 239/585.1; 239/585.2; 239/585.3; 239/585.4; 239/585.5; 239/533.2; 239/533.3; 239/596

(58) Field of Search ..... 239/5, 533.2, 533.3, 239/533.12, 533.14, 461, 596, 585.1, 585.2, 585.3, 585.4, 585.5

(56) References Cited

U.S. PATENT DOCUMENTS

| | | | | |
|---|---|---|---|---|
| 4,828,184 A | | 5/1989 | Gardner et al. | 239/590.3 |
| 5,383,597 A | * | 1/1995 | Sooriakumar et al. | 239/5 |
| 5,449,114 A | * | 9/1995 | Wells et al. | 239/5 |
| 5,570,841 A | | 11/1996 | Pace et al. | 239/585.1 |
| 5,685,491 A | | 11/1997 | Marks et al. | 239/533.12 |
| 5,899,390 A | | 5/1999 | Arndt et al. | 239/553 |
| 5,924,634 A | | 7/1999 | Arndt et al. | 239/553 |
| 6,050,507 A | | 4/2000 | Holzgrefe et al. | 239/585.1 |
| 6,142,390 A | | 11/2000 | Nordstrom et al. | 239/490 |
| 6,161,782 A | | 12/2000 | Heinbuck et al. | 239/585.1 |
| 6,168,099 B1 | | 1/2001 | Hopf et al. | 239/596 |
| 6,170,763 B1 | | 1/2001 | Fuchs et al. | 239/533.12 |
| 6,230,992 B1 | * | 5/2001 | Arndt et al. | 239/585.1 |
| 6,405,945 B1 | * | 6/2002 | Dobrin | 239/533.12 |

* cited by examiner

*Primary Examiner*—Robin O. Evans

(57) ABSTRACT

A method and apparatus for defining a spray pattern to reduce the variation in the metering, targeting, distribution, and atomization of the fuel output of a fuel injector. The fuel injector contains a closure member extending along the longitudinal axis of the injector. The closure member can be positioned contiguous to a seat to occlude fuel flow. A sealing radius is defined when the closure member is in this position. The closure member can also be positioned such that it is not contiguous to the seat, thereby permitting fuel flow. A plate is disposed proximate to the seat with a first and second face, the first face facing the seat. An inlet is located on the first face of the plate, and at least one chamber is disposed on the second face of the plate. The inlet and the at least one chamber are in fluid communication. An orifice disc is disposed in a confronting arrangement with the second face of the plate such that each chamber is located proximal to each orifice. The orifice disc is positioned such that its axis is generally coincident with the longitudinal axis of the fuel injector. At least one orifice is located at a second radius from the axis of the orifice disc, wherein the second radius is greater than the sealing radius.

23 Claims, 5 Drawing Sheets

METHOD AND APPARATUS FOR DEFINING A SPRAY PATTERN FROM A FUEL INJECTOR

BACKGROUND OF THE INVENTION

The fuel injector is believed to be an integral component of fuel systems, which deliver fuel to intake valves, and/or the combustion chamber of an internal combustion engine. It is believed that engine performance can be improved by minimizing injector performance variance. It is also believed that injector performance variance can be minimized via controlling the spray direction, the spray particle size, the spray mass flow, and the spray pattern in a repeatable fashion.

It is believed that in known injector designs, the orifices are generally located in close proximity to one another inline with the fuel flow path created by the interaction of the needle/seat geometry within the fuel injector. It is further believed that the resulting spray characteristics may be influenced by interaction between flow streams associated with the orifices due to the close proximity of the orifices to one another. It is also believed that resulting spray characteristics may be influenced by variations in upstream geometry due to the close proximity of the orifices to the needle/seat geometry.

SUMMARY OF THE INVENTION

The present invention provides a fuel spray device for a fuel injector. The fuel injector has a longitudinal axis between a first end and a second end of the fuel injector. A closure member extends along the longitudinal axis in a first position contiguous to a seat to occlude fuel flow to the second end and a second position permitting fuel flow to the second end. The closure member has a sealing radius when the closure member is in the first position. The device comprises a plate disposed proximate to the seat, the plate having a first face and a second face, the first face having an inlet, the second face having at least one chamber disposed thereon, the at least one chamber being in fluid communication with the inlet; an orifice disc disposed in a confronting arrangement with the second face of the plate, the orifice disc having an axis generally coincident with the longitudinal axis; and at least one orifice located at a second radius from the axis of the orifice disc, wherein the second radius is greater than the sealing radius.

The present invention further provides for a fuel injector. The fuel injector comprises an injector body including an inlet, an outlet, and a passageway extending along a longitudinal axis, the passageway providing fuel flow from the inlet to the outlet of the injector body; a closure member positionable in the passageway between a first position blocking the passageway and another position permitting fuel flow; a seat contiguous to the closure member to form a sealing radius when the closure member is in the first position; a plate disposed adjacent the seat, the plate having a first face and a second face, the first face having a generally circular inlet, the second face having at least one chamber in fluid communication with the generally circular inlet; and an orifice disc in a confronting arrangement with the second face of the plate, the orifice disc including at least one orifice located about an axis of the orifice disc at a distance greater than the sealing radius.

The present invention additionally provides a method of forming a spray nozzle for a fuel injector. The fuel injector has an inlet, an outlet, and a passageway extending along a longitudinal axis. The fuel injector further includes a closure member movable in the passageway between one position blocking the passageway and another position permitting fuel flow, and a seat contiguous to the closure member to form a sealing radius when the closure member is positioned to block the passageway. The method comprises forming an inlet in a first face of a plate and at least one chamber in a second face of the plate, the first face of the plate facing the seat; and forming at least one orifice on a disc, the at least one orifice disposed at a second radius greater than the sealing radius, the disc located in a confronting arrangement with the second face of the plate.

The present invention further provides a method of generating multiple streams of atomized fuel from a fuel injector. The fuel injector has a passageway extending along a longitudinal axis, and a closure member movable in the passageway between one position blocking the passageway and another position permitting fuel flow. The fuel injector also contains a seat contiguous to the closure member which defines a sealing radius when the closure member is positioned in the one position, and a plate having a first and second face. The plate disposed in a stack like arrangement between the seat and an orifice disk. The plate has an inlet disposed in the first face and a plurality of chambers disposed in the second face. The plurality of chambers disposed in a confronting arrangement with at least one orifice. The method comprises directing fuel through the inlet toward the plurality of chambers; and emitting fuel through the at least one orifice located at a radius greater than the sealing radius such that at least one specified spray pattern is obtained from the fuel injector.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENT

Figure 1:
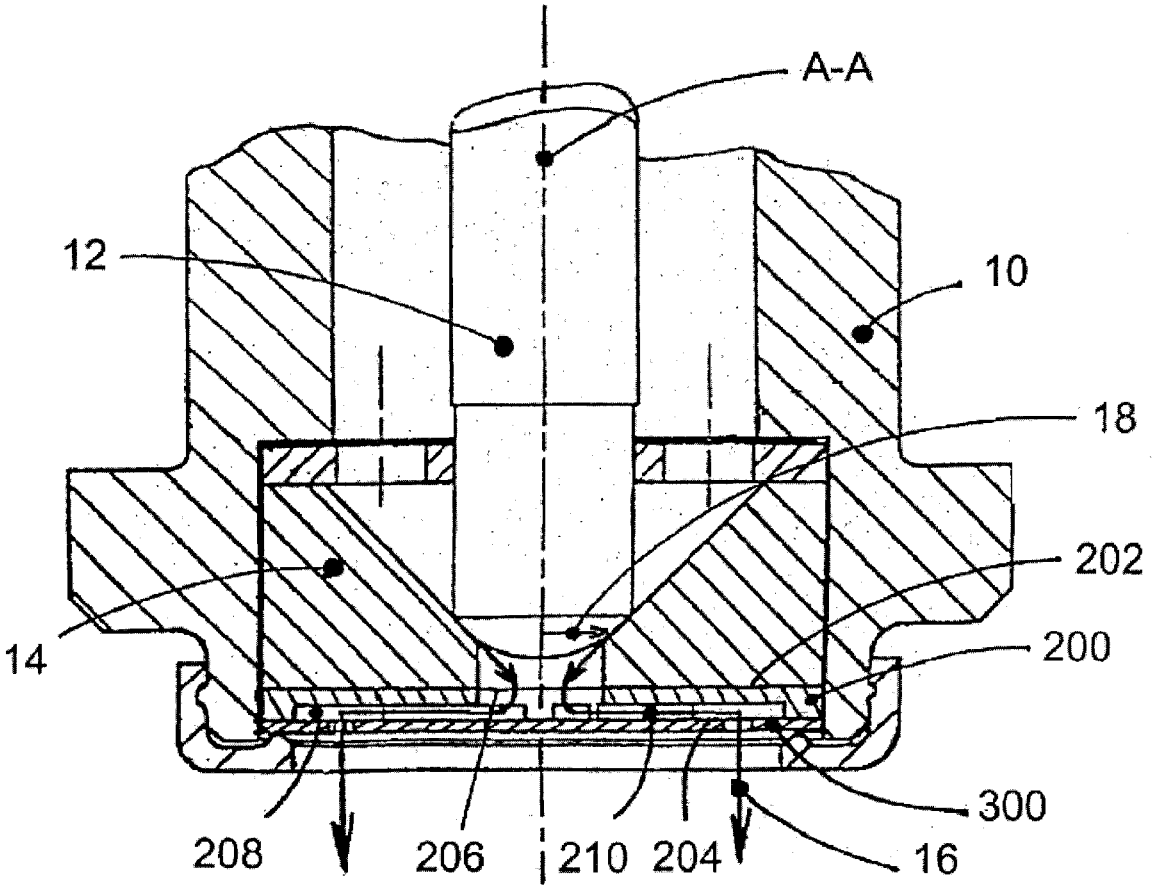
FIG. 1 is a schematic illustration of a fuel spray device with a fuel injector valve body assembly.
Figure 2A:
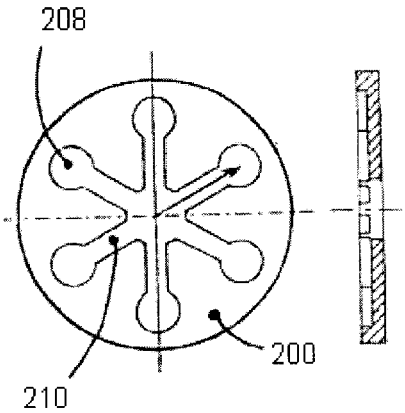
FIGS. 2A–2C are cross sectional views of the velocity preparation plate and orifice disc of the fuel spray device of FIG. 1.

FIGS. 1 and 2A–2C show a partial cross section of a fuel injector valve body assembly 10 with a fuel spray device 100 that includes a plate 200 and an orifice disk 300 suitable for use in, but not limited to, high pressure, medium pressure, and diesel fuel applications. The valve body assembly 10 of the fuel injector contains a closure member 12 extending along the longitudinal axis A—A of the injector. The closure member 12 can be positioned contiguous to a seat 14 to occlude fuel flow 16. A sealing radius 18 is defined when the closure member 12 is in this position. The closure member 12 can also be positioned such that it is not contiguous to the seat 14, thereby permitting fuel flow 16. A plate 200 is disposed proximate to the seat 14 with a first face 202 and a second face 204, the first face 202 facing the seat 14. An inlet 206 is located on the first face 202 of the plate 200, and at least one chamber 208 (six are shown in FIG. 2A) is disposed on the second face 204 of the plate 200. The inlet 206 and at least one chamber 208 are in fluid communication. As shown in FIG. 2, the chamber 208 is generally cylindrical in shape, and the inlet 206 and the chamber 208 are interconnected via at least one radial channel 210 defined by generally straight parallel walls (six are shown in FIG. 2A).

The plate 200, preferably, can be manufactured as a single part, such as, for example, by EDM (Electro-Discharge-Machining) or photo-half-etching. Alternatively, the plate 200 can be manufactured by joining, for example via welding or bonding, two separate plates. Here, one plate can be formed by machining and/or stamping, with the features of the first face 202, and the other plate formed, again by machining and/or stamping, with the features of the second face 204.

Figure 2B:
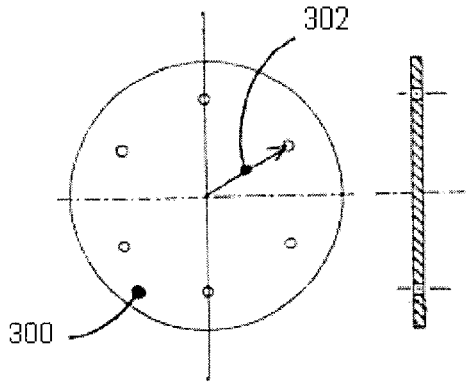

An orifice disc 300 is disposed in a confronting arrangement with the second face 204 of the plate 200 such that each chamber 208 is located proximal to each orifice. The orifice disc 300 is positioned such that its axis is generally coincident with the longitudinal axis A—A of the fuel injector. At least one orifice (six are shown in FIG. 2B) is located at a second radius 302 from the axis of the orifice disc 300. Here, the second radius 302 can be greater than the sealing radius 18. Preferably, each orifice can be configured such that its axis 304 is generally parallel to the longitudinal axis A—A of the fuel injector. Alternatively, each orifice can be configured such that its axis is not parallel to the longitudinal axis A—A of the fuel injector, or the orifices can be configured such that some have an axis generally parallel to the longitudinal axis A—A of the fuel injector, while others do not. The axis of one or more of the orifices could also be curvilinear.

Figure 2C:
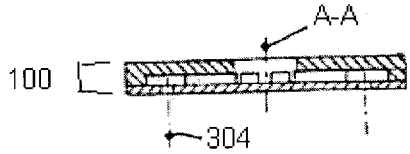

The geometry of the chambers 208 and channels 210 on the plate 200 and the position of the orifices on the orifice disc 300 shown in FIGS. 2A–2C are believed to produce at least one specific spray pattern from the fuel injector. Alternatively, the geometry of the chambers 208 and channels 210 on the plate 200 and the position of the orifices on the orifice disc 300 can be varied from what is shown in FIGS. 2A–2C to develop other distinct spray patterns from the fuel injector. The spray pattern is believed to be related to the velocity profile of the fuel flow through the channels 210, chambers 208, and orifices of the plate 200 and orifice disc 300. As used here, the term "velocity profile" denotes a graphical representation of individual fluid streamlines past a selected cross-section at any portion of the preferred embodiments. The velocity profile is obtained by plotting the velocity of each fluid streamline as it passes a selected referential cross-sectional area. By using the velocity profile, a volumetric flow rate and an average flow velocity can be obtained such that various types of fluid flow can be determined.

Figure 3A:
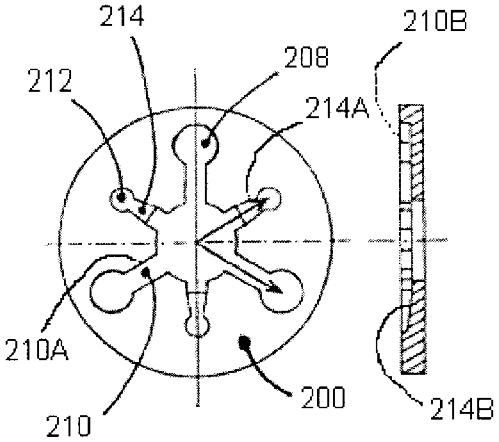
FIGS. 3A–3C are cross sectional views of a variation of the plate and disc of FIG. 2.
Figure 3B:
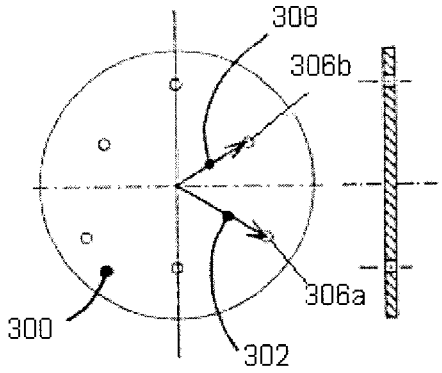
Figure 3C:
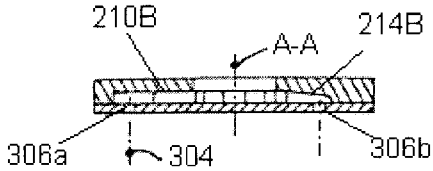

FIGS. 3A–3C illustrate a variation of the plate 200 and orifice disc 300. The inlet 206 in the first face 202 of the plate 200 and at least one first chamber 208 (three are shown in FIG. 3A) in the second face 204 of the plate 200 are interconnected via at least one radial channel 210 (three are shown in FIG. 3A) defined by generally parallel walls 210A, 210B, and the inlet 206 and at least one second chamber 212 (three are shown in FIG. 3A) are interconnected via at least one radial channel 214 (three are shown in FIG. A) defined by walls having a first channel wall contour 214A and a top wall contour 214B. The substantial narrowing of the contoured walls 214A and 214B is believed to cause a change in fuel flow velocity profile in the second chamber 212 relative to the fuel flow velocity profile in the first chamber 208, where the walls 210A and 210B are generally parallel. Consequently, it is believed that at least one different spray pattern will be emitted from the orifice 306*a* proximate second chamber 212 than the spray pattern emitted from the orifice 306*b* proximate to first chamber 208.

A first plurality of orifices 306*a* (three are shown in FIG. 3B) in the orifice disc 300 are located on a second radius 302 from the axis of the orifice disc 300 and a second plurality of orifices 306*b* (three are shown in FIG. 3B) are located on a third radius 308 different from the second radius 302. Each orifice is configured such that its axis 304 is parallel to the longitudinal axis A—A of the fuel injector.

Figure 4A:
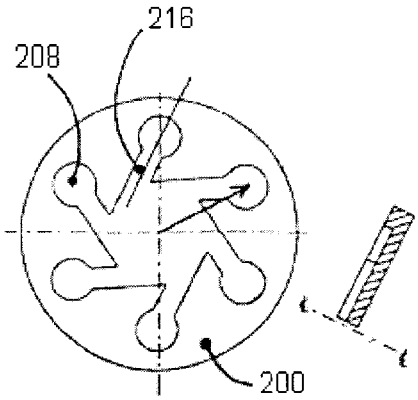
FIGS. 4A–4C are cross sectional views of a variation of the plate and disc of FIG. 2.
Figure 4B:
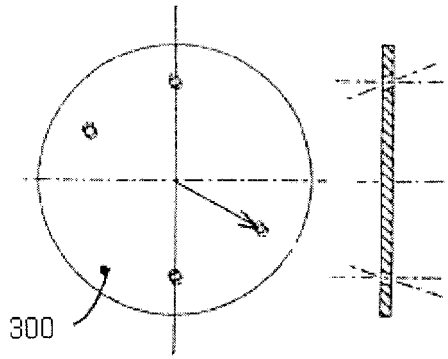
Figure 4C:
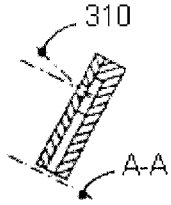

Another variation of the plate 200 and orifice disc 300 is shown in FIGS. 4A–4C. The inlet 206 in the first face 202 of the plate 200 and the at least one chamber 208 (six are shown in FIG. 4A) in the second face 204 of the plate 200 are interconnected via skewed channels 216 defined by generally straight walls. Also, each orifice is configured such that its axis 310 is not parallel to the longitudinal axis A—A of the fuel injector. Alternatively, the axis 310 can be configured as a curvilinear axis (not shown).

Figure 5A:
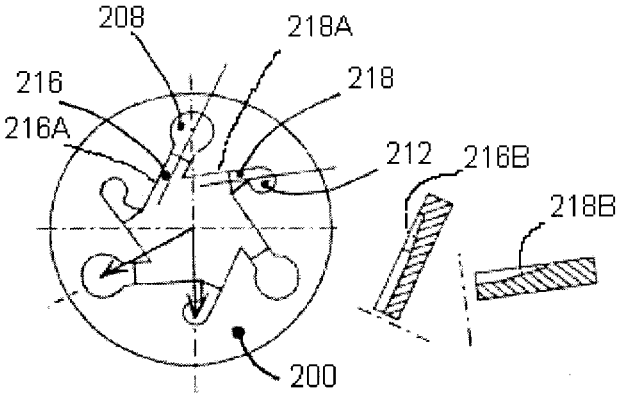
FIGS. 5A–5C are cross sectional views of a variation of the plate and disc of FIG. 2.
Figure 5B:
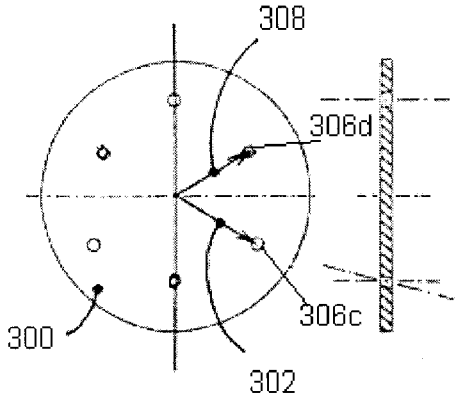
Figure 5C:
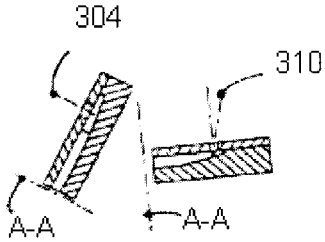

A final variation of the plate 200 and orifice disc 300 is shown in FIGS. 5A–5C. The inlet 206 in the first face 202 of the plate 200 is interconnected with at least one first chamber 208 (three are shown in FIG. 5A) in the second face 204 of the plate 200 via at least one skewed channel 216 (three are shown in FIG. 5A) defined by walls 216A with a second contour and a top wall 216B defined by a third contour, and the inlet 206 in the first face 202 of the plate 200 is interconnected with at least one second chamber 212 (three are shown in FIG. 5A) in the second face 204 of the plate 200 via at least one skewed channel 218 (three are shown in FIG. 5A) defined by walls 218A defined by a fourth wall contour and top wall 218B defined by a fifth contour. The different contours of the channels 216 and 218 are believed to develop different velocity profiles of fuel flow. Also, it is believed that the fuel flow velocity profile in the first and second chambers 208 and 212 will be effected by the generally narrowing of the first and second chambers 208 and 212. As such, it is believed that the fuel spray pattern emitted from the orifices 306*c* and 306*d* proximate to the first and second chambers 208 and 212, respectively, will be different from each other.

A first plurality of orifices 306*c* (three are shown in FIG. 5B) in the orifice disc 300 are located on a second radius 302 from the axis of the orifice disc 300 and a second plurality of orifices 306*d* (three are shown in FIG. 5B) are located on a third radius 308 different from the second radius 302. Three of the orifices are configured such that their axis 304 are generally parallel to the longitudinal axis A—A of the fuel injector, while the three other orifices are configured such that their axes 310 are generally non-parallel to the longitudinal axis A—A of the fuel injector. As used here, the term "non-parallel" indicates that the axes of the orifices can be linear axes or curvilinear axes (not shown).

In operation, when the closure member 12 is not contiguous to the seat 14, fuel flows through the orifice in the seat 14 and into the inlet 206 in the first face 202 of the plate 200. The fuel is then directed toward the plurality of chambers 208 located on the second face 204 of the plate 200. The fuel may be directed toward the chambers 208 in a direction oblique from the longitudinal axis A—A of the fuel injector. After entering the chambers 208, the velocity profile of the fuel can be altered due to different contours defined by the walls of the chambers such as, for example, those shown in FIGS. 3C, 4C and 5C. Next, fuel is emitted through the plurality of orifices in the orifice disc 300, where the orifices are located at a radius greater than the sealing radius 18, such that at least one specified spray pattern is obtained from the fuel injector. The fuel can be emitted through at least one orifice in a direction oblique from the longitudinal axis A—A of the fuel injector, and/or through at least two or more orifices located at different radii.

The preferred embodiments are believed to decrease the possibility that flow stream interaction and/or variations in upstream geometry can affect the metering, targeting, distribution, and atomization of fuel spray by locating the orifices radially further from one another and from the needle/seat geometry. Also, by locating the orifices radially further from one another, it is believed that the preferred embodiments permit the use of a greater number of orifices than known injector designs. Finally, the preferred embodiments are believed to provide a fuel flow velocity preparation plate that uniformly controls the fluid velocity profile of the fluid flow to each orifice. It is believed that the preferred embodiments further decrease the possibility that flow steam interaction and/or variations in upstream geometry will effect the metering, targeting, distribution, and atomization of fuel spray. It is further believed that the preferred embodiments allow for distinct fuel flow velocity profiles to be developed for each orifice or each fuel injector and orifice combination.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What we claim is:

1. A fuel spray device for a fuel injector, the fuel injector having a longitudinal axis between a first end and a second end of the fuel injector, a closure member extending along the longitudinal axis in a first position contiguous to a seat to occlude fuel flow to the second end and a second position permitting fuel flow to the second end, the closure member having a sealing radius when the closure member is in the first position, the device comprising:

a plate disposed proximate to the seat, the plate having a first face and a second face, the first face having an inlet, the second face having at least one chamber disposed thereon, the at least one chamber being in fluid communication with the inlet;

an orifice disc disposed in a confronting arrangement with the second face of the plate, the orifice disc having an axis generally coincident with the longitudinal axis; and at least one orifice located at a second radius from the axis of the orifice disc, wherein the second radius is greater than the sealing radius.

2. The device as claimed in claim 1, wherein the at least one orifice includes a first plurality of orifices located on a second radius and a second plurality of orifices located on a third radius different from the second radius.

3. The device as claimed in claim 1, wherein the second face further comprises at least one channel extending between the inlet and the at least one chamber.

4. The device as claimed in claim 3, wherein the at least one channel extends from the inlet to the at least one chamber in a radial configuration.

5. The device as claimed in claim 3, wherein the at least one channel extends from the inlet to the at least one chamber in a skewed configuration.

6. The device as claimed in claim 3, wherein the at least one channel is defined by generally parallel walls.

7. The device as claimed in claim 3, wherein the at least one channel is defined by at least two contoured walls.

8. The device as claimed in claim 3, wherein the at least one channel comprises at least one channel defined by generally parallel walls and at least one channel defined by contoured walls.

9. The device as claimed in claim 3, wherein the chamber is proximate each orifice.

10. The device as claimed in claim 1, wherein each orifice comprises an axis generally parallel to the longitudinal axis.

11. The device as claimed in claim 1, wherein each orifice comprises an axis generally non-parallel to the longitudinal axis.

12. The device as claimed in claim 1, wherein the at least one orifice comprises at least one orifice having an axis generally parallel to and at least one orifice having an axis generally non-parallel to the longitudinal axis.

13. The device as claimed in claim 12, wherein the nonparallel axis comprises a curvilinear axis.

14. The device as claimed in claim 1, wherein the chamber comprises a generally cylindrical chamber.

15. A fuel injector, comprising:

an injector body including an inlet, an outlet, and a passageway extending along a longitudinal axis, the passageway providing fuel flow from the inlet to the outlet of the injector body;

a closure member positionable in the passageway between a first position blocking the passageway and another position permitting fuel flow;

a seat contiguous to the closure member to form a sealing radius when the closure member is in the first position;

a plate disposed adjacent the seat, the plate having a first face and a second face, the first face having a generally circular inlet, the second face having at least one chamber in fluid communication with the generally circular inlet; and an orifice disc in a confronting arrangement with the second face of the plate, the orifice disc including at least one orifice located about an axis of the orifice disc at a distance greater than the sealing radius.

16. A method of forming a spray nozzle for a fuel injector, the fuel injector having an inlet, an outlet, and a passageway extending along a longitudinal axis, a closure member movable in the passageway between one position blocking the passageway and another position permitting fuel flow, a seat contiguous to the closure member to form a sealing radius when the closure member is in the one position, the method comprising:

forming an inlet in a first face and at least one chamber in a second face of a plate, the first face of the plate facing the seat; and forming at least one orifice on a disc, the at least one orifice disposed at a second radius greater than the sealing radius, the disc located in confronting arrangement with the second face of the plate.

17. A method of generating multiple streams of atomized fuel from a fuel injector, the fuel injector having a passageway extending along a longitudinal axis, a closure member movable in the passageway between one position blocking the passageway and another position permitting fuel flow, a seat contiguous to the closure member to define a sealing radius when the closure member is in the one position, a plate having a first face and a second, the plate disposed in a stack like arrangement between the seat and an orifice disk, the plate having an inlet disposed in the first face and a plurality of chambers disposed in the second face, the plurality of chambers disposed in a confronting arrangement with at least one orifice, the method comprising:

directing fuel through the inlet towards the plurality of chambers; and emitting fuel through the at least one orifice located on the orifice disk at a radius greater than the sealing radius such that at least one specified spray pattern is obtained from the fuel injector.

18. The method as claimed in claim 17, wherein the directing further comprises directing the fuel towards the plurality of chambers in a direction oblique from the longitudinal axis.

19. The method as claimed in claim 17, wherein the emitting further comprises directing fuel through the at least one orifice in a direction generally parallel to the longitudinal axis.

20. The method as claimed in claim 17, wherein the emitting further comprises directing fuel through the at least one orifice in a direction generally nonparallel to the longitudinal axis.

21. The method as claimed in claim 20, wherein the nonparallel axis comprises a curvilinear axis.

22. The method as claimed in claim 17, wherein the emitting further comprises directing fuel through at least two or more orifices located at different radii.

23. The method as claimed in claim 17, wherein the directing further comprises changing a velocity profile of the fuel in at least one chamber of the plurality of chambers such that a flow of fuel through the chamber is different from a flow through another of the plurality of chambers.

* * * * *